US006131451A

United States Patent [19]

Izbicki et al.

[11] Patent Number: 6,131,451

[45] **Date of Patent: *Oct. 17, 2000**

[54] WELL FLOWMETER AND DOWN-HOLE SAMPLER

[75] Inventors: John Izbicki, San Clemente; Allen H. Christensen, La Mesa; Steven M. Crawford, San Diego; Randall T. Hanson, San Diego; Peter Martin, San Diego; Gregory Smith, San Diego, all of Calif.

[73] Assignee: The United States of America as represented by the Secretary of the Interior, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,364

[22] Filed: Feb. 5, 1998

[51] Int. Cl.[7] ..... E31B 47/10

[52] U.S. Cl. ..... 73/152.18

[58] Field of Search ..... 73/152.18, 152.29

[56] References Cited

U.S. PATENT DOCUMENTS

| | | | |
|---|---|---|---|
| 2,453,456 | 11/1948 | Piety . | |
| 3,123,708 | 3/1964 | Limanek . | |
| 3,345,868 | 10/1967 | Brink . | |
| 3,690,167 | 9/1972 | Chase, Jr. et al. | 73/152.29 |
| 4,505,155 | 3/1985 | Jackson | 73/152.18 |
| 4,553,429 | 11/1985 | Evans et al. . | |
| 4,615,390 | 10/1986 | Lucas et al. | 73/152.29 |
| 4,629,218 | 12/1986 | Dubois . | |
| 4,715,443 | 12/1987 | Gidley . | |
| 4,745,801 | 5/1988 | Luzier . | |
| 4,854,164 | 8/1989 | Rhoads | 73/152.29 |
| 4,972,704 | 11/1990 | Wellington et al. | 73/152.18 |
| 5,016,712 | 5/1991 | Cullick et al. | 73/152.18 |
| 5,297,425 | 3/1994 | Hamby et al. . | |
| 5,337,838 | 8/1994 | Sorensen . | |
| 5,388,455 | 2/1995 | Hamby et al. . | |
| 5,520,046 | 5/1996 | Sornein et al. . | |
| 5,723,781 | 3/1998 | Pruett et al. | 73/152.18 |

*Primary Examiner*—Hezron Williams
*Assistant Examiner*—Jay L. Politzer
*Attorney, Agent, or Firm*—Antonelli, Terry, Stout & Kraus, LLP

[57] ABSTRACT

An apparatus for and a process of evaluating well bore flow of water and for sampling of water within a well. A hose is inserted into the well to a known depth. To evaluate the water, a tracer fluid is introduced into the hose until the pressure within the hose exceeds the hydrostatic pressure at the known depth by a preset amount. The tracer fluid is then rapidly released into the well. The tracer fluid is detected in water pumped from the well, and the elapsed time between release of the tracer fluid into the well and detection of the tracer fluid in the water pumped from the well is determined. The process is repeated at a second known depth, and the tracer fluid travel time between the two depths is determined. From this and the cross-sectional area of the well, the incremental volumetric well bore inflow to the well between the two depths is calculated. The process can be repeated at several depths within the well to permit construction of a velocity profile of water movement within the well. To obtain a water sample from the well, the hose is inserted to the desired depth, and an inert gas is introduced into the hose. The gas is then vented from the hose, and water from the well enters the hose to replace the vented gas. The hose is then withdrawn from the well, and gas is again introduced into the hose, causing the water sample to be discharged. Appropriate valves are provided to control the apparatus.

13 Claims, 3 Drawing Sheets

WELL FLOWMETER AND DOWN-HOLE SAMPLER

FIELD OF THE INVENTION

The present invention relates to an apparatus for and a process of evaluating well bore flow and of sampling of water within a well.

BACKGROUND OF THE INVENTION

In groundwater studies, hydrologic data obtained from production wells are often used to describe and simulate regional groundwater conditions. Production wells commonly are perforated over long intervals and yield groundwater from more than one water-bearing zone or aquifer. Determining which water-bearing zone particular data represent, as well as determining the area distribution for that data and the change of data over time, may be impossible using indirect is information such as well construction data, geophysical logs from long-screened production wells, and composite water-chemistry samples from well surface discharge. Currently available equipment for obtaining information on the velocity distribution and entry of water into a well bore includes vertical-flow impeller-type flow meters, and heat pulse, electromagnetic, video camera, and sonic geophysical tools. These existing tools are commonly three to six feet in length and have diameters greater than two inches. As a result, these devices cannot be used in wells that have small entry tubes or restricted space within the well. Further, these devices cannot negotiate bends which are commonly encountered in production wells. Many of these tools also have upper and/or lower limits to the range of flow rate that they can determine, and these limits handicap their use in determining the wide range of discharge rates found in monitoring and production wells. Well bore velocity may vary greatly within a well, and may not be known until at least one test has been made. Then it might be necessary to change a tool and retest.

Depth dependent data, obtained from observation wells which are perforated over specific intervals, can be used to directly determine the water level, water chemistry, and aquifer properties of individual water-bearing zones. However, such wells are expensive to construct, and provide data only for selected water-bearing zones that may not be representative of the remainder of the aquifer. Currently available equipment for such purposes include wire line, bailer, and downhole samplers. Many of these tools are also of a size that limits there access into production and monitoring wells.

SUMMARY OF THE INVENTION

The present invention is an apparatus for and a process of evaluating water within a well. In a first aspect, the present invention is an apparatus for measuring travel time and estimating well bore water flow within a well and for sampling water or other fluids from the well. The apparatus includes a hose for insertion into the well, a reservoir of tracer fluid to be injected through the hose and into the well at a known depth so that the tracer fluid will be present in water pumped from the well, a source of gas, a receptacle for receiving waste and vented tracer fluid and gas, and valves which can be positioned alternatively to a first valve position, to permit tracer fluid from the reservoir or gas from the gas source to pass into the hose, and to a second valve position, to permit a sample of water from the well to enter the hose while the gas is vented from the hose to the receptacle. The apparatus further includes a detector for detecting the tracer fluid in water pumped from the well, and a timer for recording the elapsed time between injection of the tracer fluid into the well and detection of the tracer fluid in water pumped from the well. By making measurements at two or more depths a known distance apart within the well, and calculating the time difference, the incremental well bore unit velocity between the two depths can be determined. From this and the unit volume of the well bore (i.e., the well bore cross-sectional area multiplied by one foot of well bore length), the incremental volumetric well bore inflow to the well between the two depths can be determined. If measurements are made at several different depths, a velocity profile of the water movement within the well can be constructed. For sampling, the hose is pressurized, lowered to the desired depth in the well, and depressurized to allow a sample of water from the well to enter the hose. Once the water sample is within the hose, the hose is withdrawn from the well, and the valves positioned to permit gas to again enter the hose, forcing the water sample from the hose.

In another aspect, the present invention is a process of measuring travel time and estimating well bore flow of water within a well, including discharging a tracer fluid into the well at a known depth, pumping water from the well, detecting the tracer fluid from the water pumped from the well, and determining the elapsed time between discharging of the tracer fluid into the well and detection of the tracer fluid in the water pumped from the well. This process can be repeated at other known depths to permit construction of a velocity profile of the flow within the well bore.

A third aspect of the present invention is a process of obtaining a water sample from a well, including pressurizing a hose with gas, lowering the hose into the well, venting the gas from the hose to allow a water sample from the well to enter the hose, withdrawing the hose, with the sample therein, from the well, and again injecting gas into the hose to cause the water sample in the hose to be discharged into a receptacle.

The determination of depth-dependent inflow of water into the well and the related water chemistry under pumped conditions allows the determination of regionally extensive water-bearing zones, the distribution of pumpage among multiple water-bearing zones for groundwater flow modeling, and improved estimates of aquifer hydraulic properties and distribution of water-quality attributes within single- or multiple-aquifer systems. The depth-dependent inflow into the well under pumped conditions and depth-dependent sampling of chemical constituents can be used with other hydrologic, geochemical, geological, and geophysical information to design additional water-supply or monitoring wells in the same geohydrologic setting.

Depth-dependent sampling, in combination with other geophysical-survey well bore logs, can be used to determine the source, movement, age, and origin of waters entering the well bore and the mixture of the waters flowing into the well bore or through the well bore from different water bearing units. Such information can likewise be used to determine the source, movement, age, and origin of water that contains contaminants that are either natural or human-induced. Depth-dependent sampling in combination with other geophysical logs can also be used to determine the relative mixtures and rates of inflow of waters entering the well bore at different pumping rates from different water-bearing units, or flowing through the well bore between different water-bearing units that are at different or variable ambient pressures. This information can be used to determine the bacterlogical and chemical sources, types, mixtures of encrustation on the interior of well casings or within well screens, and aquifer characteristics.

BRIEF DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF PREFERRED EMBODIMENTS

Figure 1:
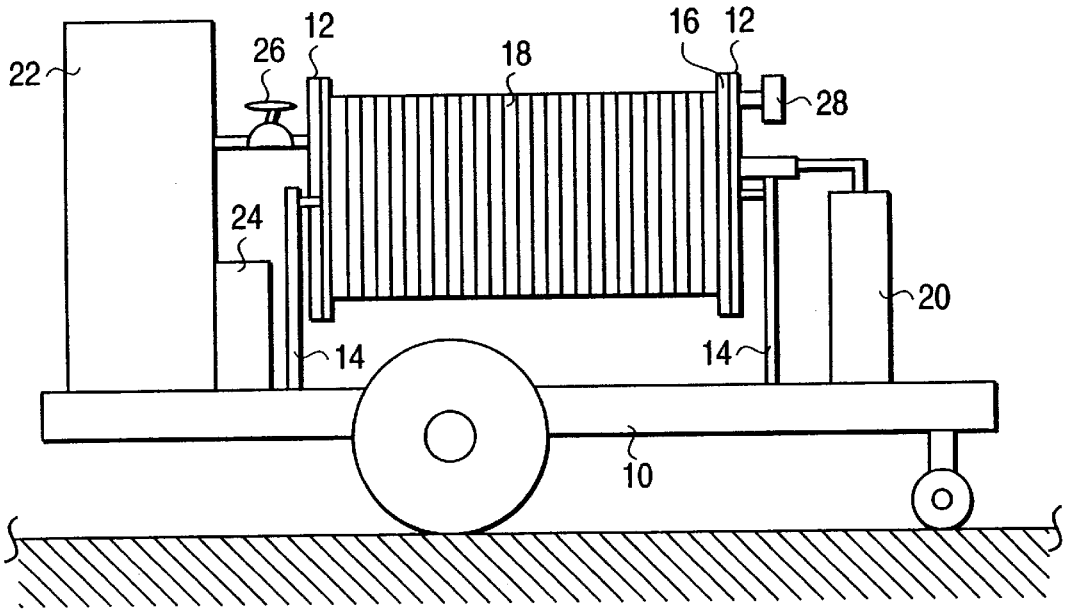
FIG. 1 is a schematic diagram depicting a preferred embodiment of an apparatus for evaluating water chemistry and water movement within a well in accordance with the present invention.

FIG. 1 depicts a preferred embodiment of apparatus suitable for evaluating water chemistry and well bore flow of water within a well in accordance with one aspect of the present invention. A trailer 10 has mounted on it a frame 12, 14 for supporting a reel 16 on which a high pressure hose 18 is wound. The hose and all of its fittings are less than one inch in diameter. By way of example, a high-pressure teflon core hose might be used. A drive motor 20 preferably is provided for the hose reel 16, although the hose could be manually fed from and onto the reel, if desired. A reservoir 22 contains a tracer fluid such as distilled water with Rhodamine WT dye, and a hydraulic injection pump 24 is provided to pump the tracer fluid through the hose 18 under high pressure and controlled by a valve 26. A vent valve 28 is provided for venting hose 18.

Figure 2:
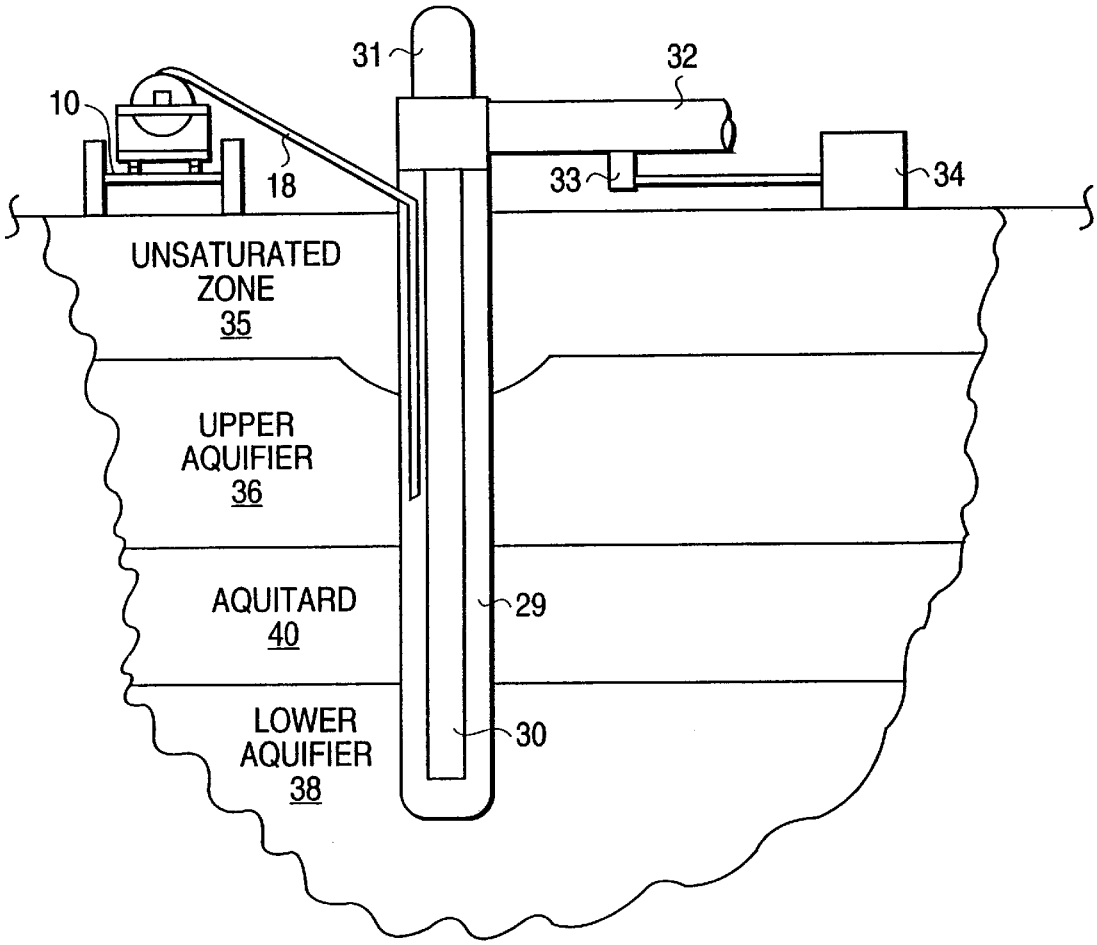
FIG. 2 is a schematic vertical cross section of a typical well and related equipment, including the equipment of FIG. 1, suitable for use in evaluating water chemistry and well bore flow of water within a well in accordance a preferred embodiment of with the present invention.

FIG. 2 illustrates the injection of the tracer fluid into a well bore 29. The discharge end of hose 18 is inserted into the well bore to a desired depth. Preferably, the hose is passed through an entry tube (not shown). In a production well, a pump-discharge column pipe 30, having pump bowls thereon, is connected to a turbine pump or a submersible pump to pump water from the well. Typically, the clearance between the well casing and the pump bowls is less than two inches. However, since hose 18 and its fittings are less than one inch in diameter, they are readily insertable into the clearance. In a production well, a pump 31 draws water from within the well to a discharge pipe 32. A monitoring port 33 connects the discharge pipe 32 to monitoring equipment within monitoring and control unit 34 to permit monitoring of the water from the well and control of the apparatus. The monitoring equipment might include a fluorometer to detect the injected tracer fluid, as well as digital and graphical recording devices, a volumetric mass-balance integration device, and a graphic display for logging and displaying data about the well.

The well site typically might include an unsaturated zone which is adjacent the ground's surface and from which no water is obtained, an upper aquifer zone 36, an intermediate aquitard zone 40, and a lower aquifer zone 38. Water might be pumped from either or both of upper aquifer zone 36 and lower aquifer zone 38.

Figure 3:
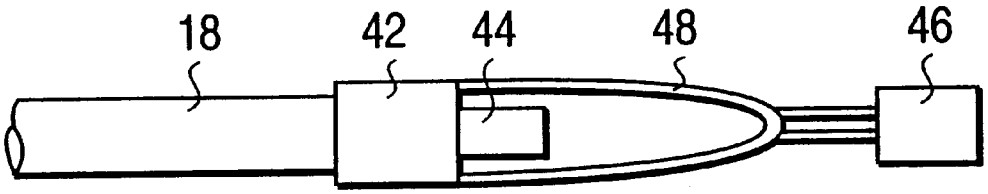
FIG. 3 is a fragmentary view depicting an attachment usable in evaluating and sampling water within a well in accordance with the present invention.

FIG. 3 is an enlarged fragmentary view of the discharge end of hose 18 during tracer injection. A quick-disconnect fitting 42 couples a pressure-relief valve 44 to the end of hose 18. Preferably, a weight 46 is suspended by a hanger 48 from the end of hose 18 to aid in entry of the hose into the well bore.

To evaluate well bore flow of water within a well utilizing the apparatus as depicted in FIGS. 1 and 2, the discharge end of hose 18, having pressure-release valve 44 and weight 46 attached thereto, is lowered into the well bore to a desired known depth, as illustrated in FIG. 2. Valve 26 is opened to permit the tracer fluid to enter hose 18. Hydraulic injection pump 24 assures that a continuous column of fluid, void of any gas or vapor phase, enters the hose. When the hose is completely filled, the pump 24 causes an increase in the fluid pressure within the hose until pressure release valve 44 opens, rapidly injecting the tracer fluid into the well bore. The pressure at which valve 44 opens is greater than the hydrostatic pressure of the fluid within the well at the depth to which the hose is inserted. The response time, between pressurization and dye release, is relatively short as compared to the travel time of water from within the well to the monitoring port 33, for example being less than or equal to one second. If desired, an electrically controlled valve might be utilized, rather than a pressure release valve 44, to reduce the response time.

The detector within equipment 34 detects the arrival of the tracer fluid in the well bore fluid at monitoring port 33. The time which elapsed between the release of the tracer fluid from valve 44 and the arrival of the tracer fluid at monitoring port 33 is thus the travel time of the water from the depth of the end of the hose 18 to the monitoring port 33.

Hose 18 is then brought to a new known depth, either above or below the original depth, and the process is repeated, giving the travel time from that second depth. The difference between the two travel times is the travel time between the two depths, and this travel time is proportional to the incremental well bore unit velocity between the two depths within the well. The well bore unit velocity can be multiplied by the well bore cross-sectional area to give the incremental volumetric well bore inflow to the well between the two depths of tracer injection. The hose can be moved to as many different depths as desired, with the process repeated at each depth, permitting construction of a velocity profile of water movement within the well. This profile is, and is a measure of, the try of water into the well from the surrounding fluid-bearing rocks.

Figure 4:
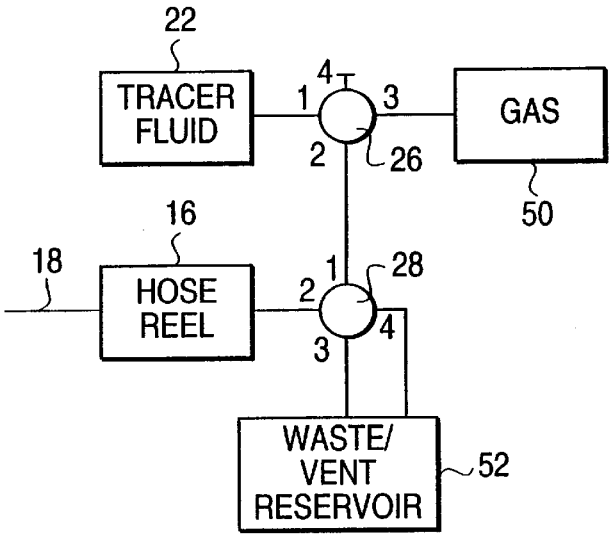
FIG. 4 is a schematic diagram depicting the connection of equipment in a preferred embodiment for well bore flow evaluation and sampling of water from a well in accordance with the present invention.

FIG. 4 depicts a preferred embodiment of an apparatus for evaluating well bore flow of water in a well and obtaining a sample of water from the well in accordance with the present invention. Reservoir 22 of tracer fluid is connected to the first port of valve 26, while the second port of valve 26 is connected to the first port of valve 28. The third port of valve 26 is connected to a source of pressurized gas 50. The second port of valve 28 is connected to hose 18 on hose reel 16. Valve 28 has its third and fourth ports connected to a waste/vent receptacle 52. The fourth port of valve 26 is capped to prevent fluid flow therethrough.

To inject tracer fluid into the well so as to evaluate the well bore flow of water within the well, the end of hose 18 is inserted into the well bore, as depicted in FIG. 2. Valve 26 is turned to provide fluid communication between its first and second ports. Valve 28 is turned to provided fluid communication between its first and fourth ports, as well as fluid communication between its second and third ports. Injector pump 24 is activated to pressurize the system. Tracer fluid passes through valves 26 and 28 to waste/vent receptacle 52. This is done to assure that injector pump 24 is not overheated prior to injection. When injection is desired, valve 28 is turned to provide fluid communication between its first and second ports and fluid communication between its third and fourth ports. Pressure builds up in hose 18 until pressure release valve 44 operates, or the electric valve is operated, to inject the tracer fluid into the well. Valve 28 is then turned to provide fluid communication between its second and third ports and fluid communication between its first and fourth ports so as to relieve excess back pressure on hose 18.

Figure 5:
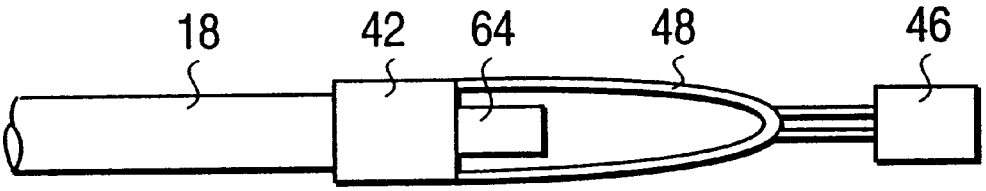
FIGS. 5 and 6 are fragmentary views depicting additional attachments usable in well bore flow evaluation and sampling of water within a well in accordance with the present invention.
Figure 6:
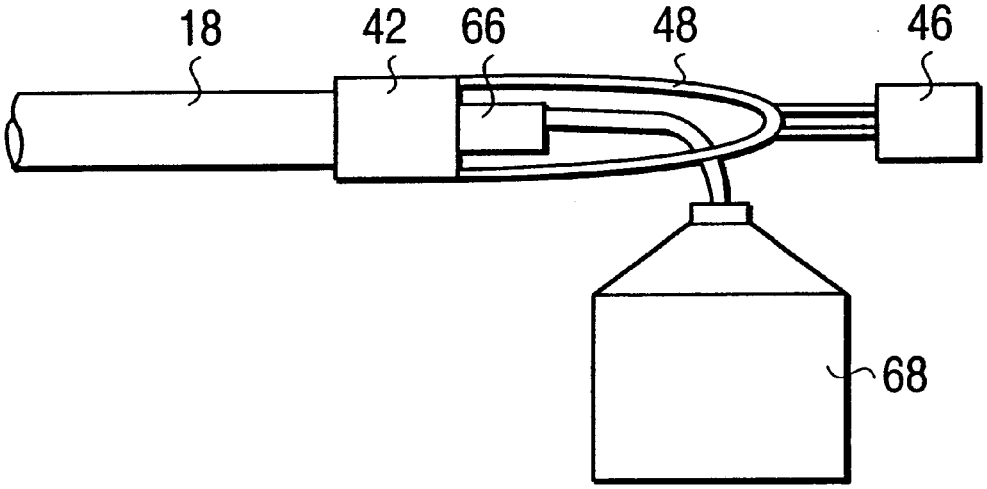

To obtain a sample of water from the well, the pressure release valve 44 is replaced by a one-way flow valve or check valve 64, as depicted in FIG. 5. Of course, all of the tracer fluid must be drained from hose 18, and the hose rinsed. Valve 26 is turned to provide fluid communication between its second and third ports, while valve 28 is turned to provide fluid communication between its first and second ports. Gas from pressurized gas source 50 then flows through valves 26 and 28 and into hose 18 to pressurize the hose to a pressure greater than the hydrostatic pressure at the depth to which the hose is to be inserted into the well. The pressurized hose is inserted into the well to that depth, and valve 28 is turned to provide fluid communication between its second and third ports and fluid communication between its first and fourth ports. The gas within hose 18 is then vented through valve 28 to waste/vent receptacle 52. A sample of water then flows through one-way valve 64 into hose 18, forcing the gas within the hose into receptacle 52. Preferably, flow of gas from source 50 is blocked to prevent overflow of receptacle 52. Once the hose is filled with the water sample, the hose is removed from the well, and one-way valve 64 is replaced by a nozzle 66 which is connected to a sample reservoir 68, as depicted in FIG. 6. Valves 26 and 28 are returned to the positions to permit gas from source 50 to flow into hose 18, and the gas then forces the water within hose 18 into reservoir 68.

Again, an electrically controlled valve could be used in place of one-way valve 64, if desired. Likewise, other substitutions, rearrangements, and alterations could be made, and still the result would be within the scope of the invention.

What is claimed is:

1. Apparatus for evaluating well bore flow of water within a well having a bore partially filled with water, the well having an outlet and means for pumping water from within the well to the well outlet for discharge therefrom, said apparatus comprising:

a hose having a first end, for insertion into the well to each of a plurality of depths known depths which are below the water in the well bore, and having a second end;

a reservoir of tracer fluid connected to said hose second end;

a pump for pumping tracer fluid from said reservoir into said hose second end and through said hose to said hose first end to substantially fill said hose with the tracer fluid;

a first valve closing said hose first end and responsive to a predetermined pressure differential across said first valve for opening said hose first end to eject tracer fluid from said hose first end and into the well water at each of the plurality of known depths to cause the tracer fluid to be pumped from the well with water from the well;

a detector for connection to the well outlet for detecting the tracer fluid in the water pumped from the well; and a timer for recording the elapsed time between opening of said first valve at each of at least two of the known depths and detection by said detector of the tracer fluid from each such known depth, and for determining the time difference between the elapsed times for the at least two known depths.

2. Apparatus as claimed in claim 1, further comprising a waste/vent receptacle; a second valve having a first port connected to said tracer fluid reservoir, a second port connected to said hose second end, and a third port connected to said waste/vent receptacle, and means for moving said second valve between a first valve position, in which said first and second ports are in fluid communication, permitting tracer fluid from said tracer fluid reservoir to enter said hose, and a second valve position, in which said second and third ports are in fluid communication, permitting relief of back pressure on said hose by venting of said hose into said waste/vent receptacle.

3. Apparatus as claimed in claim 1, wherein said first valve is a pressure-relief valve.

4. Apparatus as claimed in claim 1, wherein said first valve is an electrically-controlled valve.

5. Apparatus as claimed in claim 1, further comprising a weight attached to said hose first end.

6. Apparatus as claimed in claim 1, wherein said hose and said first valve have a maximum diameter of not more than one inch.

7. Apparatus as claimed in claim 6, wherein said hose is flexible.

8. Apparatus for evaluating well bore flow of water within a well having a bore partially filled with water, the well having an outlet and means for pumping water from within the well to the well outlet for discharge therefrom, said apparatus comprising:

means for discharging a tracer fluid into the well at each of a plurality of known depths which are below the water in the well bore;

means for detecting the tracer fluid in water pumped from the well; and means for determining the elapsed time between discharging of the tracer fluid at the known depths of the well and detection of the tracer fluid in the water pumped from the well, determining the time difference between the elapsed times for at least two of the known depths, and determining the incremental volumetric well bore inflow to the well between the at least two known depths.

9. A process of evaluating well bore flow of water within a well having a bore partially filled with water, said process comprising the steps of:

(a) discharging a tracer fluid into the well at a first known depth which is below the water in the well bore;

(b) pumping water from the well;

(c) detecting the tracer fluid in water pumped from the well;

(d) determining the elapsed time between discharging of the tracer fluid at the first known depth and detection of the tracer fluid in the water pumped from the well;

(e) discharging a second pulse of the tracer fluid into the well at a second known depth which is below the water level;

(f) repeating step (b) and (c) with respect to the second pulse of tracer fluid and at the second known depth; and (g) determining the elapsed time between discharging of the second pulse of tracer fluid at the second known depth and detection of the second pulse of tracer fluid in the water pumped from the well.

10. A process as claimed in claim 9, wherein the well has a known cross-sectional area, said process further comprising the steps of:

(h) determining the time difference between the elapsed time determined in step (d) and the elapsed time determined in step (g); and (i) from the time difference and the well cross-sectional area, determining the incremental volumetric well bore inflow to the well between the first known depth and the second known depth.

11. A process as claimed in claim 10, further comprising:

(j) repeating steps (e) through (i) a plurality of times at a plurality of different depths which are below the water level; and (k) constructing a velocity profile of water movement within the well from the determined incremental volumetric well bore inflows.

12. A process of evaluating well bore flow of water within a well having a bore partially filled with water, said process comprising the steps of:

(a) inserting a first end of a hose into the well to a first known depth which is below the water in the well bore, the hose having a valve closing said hose first end;

(b) introducing a tracer fluid into the hose to substantially fill the hose with the tracer fluid to a predetermined pressure;

(c) in response to the pressure of the tracer fluid reaching the predetermined pressure, opening the valve to eject a first injection of tracer fluid from the hose first end into the well water at the first known depth;

(d) pumping well water and tracer fluid from the first ejection from the well;

(e) detecting tracer fluid from the first ejection in water pumped from the well;

(f) determining the elapsed time between discharging of the first ejection of tracer fluid at the first known depth of the well and detection of tracer fluid from the first ejection in the water pumped from the well;

(g) moving the hose first end to a second depth which is below the water in the well bore;

(h) repeating steps (b) and (c) to eject a second injection of tracer fluid from the hose first end into the well water at the second known depth;

(i) repeating step (d) and (e) with respect to the second injection of tracer fluid; and (j) determining the elapsed time between discharging of the second injection of tracer fluid at the second known depth and detection of tracer fluid from the second injection in the water pumped from the well.

13. A process as claimed in claim 12, further comprising the steps of (k) determining the time difference between the elapsed time determined in step (f) and the elapsed time determined in step (i); and (l) from the time difference and the well cross-sectional area, determining the incremental volumetric well bore inflow to the well between the first known depth and the second known depth.

* * * * *